US005358576A

United States Patent [19]

Senno et al.

[11] Patent Number: 5,358,576

[45] Date of Patent: Oct. 25, 1994

[54] AMORPHOUS MATERIALS WITH IMPROVED PROPERTIES

[75] Inventors: Harufumi Senno, Yamatokoriyama; Hiroshi Sakakima, Hirakata; Masatsugu Yamaguchi, Kumamoto; Eiichi Hirota, Hirakata, all of Japan

[73] Assignee: Matsushita Electric Industrial Co., Ltd., Osaka, Japan

[21] Appl. No.: 157,112

[22] Filed: Jun. 6, 1980

[30] Foreign Application Priority Data

Jun. 9, 1979 [JP] Japan ..... 54-72589
Dec. 5, 1979 [JP] Japan ..... 54-158653
Jan. 11, 1980 [JP] Japan ..... 55-2417

[51] Int. Cl.[5] ..... C22C 19/07; H01F 1/047

[52] U.S. Cl. ..... 148/304; 148/313; 148/403; 420/435

[58] Field of Search ..... 75/122, 123 B, 134 F, 75/170, 171; 148/31, 32, 31.55, 31.57, 304, 313, 403; 420/435

[56] References Cited

U.S. PATENT DOCUMENTS 3,986,867 10/1976 Masumoto et al. ..... 75/134 F
4,116,682 9/1978 Polk et al. ..... 75/134 F

*Primary Examiner*—George Wyszomierski
*Attorney, Agent, or Firm*—Wenderoth, Lind & Ponack

[57] ABSTRACT

In amorphous materials including at least one iron-transition metal of Fe, Co, and Ni, and at least one metalloid of B, C, Si, and P, excellent magnetic characteristics can be provided subject to the condition that 0.5 to 10 atomic % of the above-described iron-transition metals are substituted by Mn. In addition, when the amorphous material partially substituted with Mn as described above is further comprised of at least one element selected from Groups IIIa, IVa, Va, and VIa in the periodic table, the crystallization temperature is considerably raised.

2 Claims, 9 Drawing Sheets

AMORPHOUS MATERIALS WITH IMPROVED PROPERTIES

BACKGROUND OF THE INVENTION

This invention relates to splat cooled amorphous magnetic materials.

Up to the present, it has already been well known that the splat cooled amorphous materials exhibit a number of unusual relevant properties and thus, considerable efforts are being undertaken to develop their useful applications.

By way of example, recording techniques are recently on the trend toward the high magnetic density recording and, such recording mediums as having high magnetic coercive force have been commercially available. Consequently, the demand is quite keen to obtain materials having high saturated magnetic flux density (Bs) for use as magnetic core materials of recording heads. However, in general, the materials to be used for the magnetic core materials must satisfy other requirements with respect to the material property in addition to the high saturated magnetic flux density (Bs). Namely, the materials described above are further required to show high stability of magnetic characteristics in a wide range of external stress, high corrosion resistance, high wearing resistance, high thermal stability, etc. Furthermore, so far as transformer cores are concerned, in addition to the high saturated magnetic flux density, low core loss as well as high thermal stability of magnetic characteristics are required.

According to prior research works, it has already been found that the splat cooled amorphous materials exhibit high mechanical strength (for example, 900 with respect to Vickers hardness). Thus, one can easily understand that the splat cooled amorphous materials have high wearing resistance. Some reports have already confirmed the high corrosive resistance of the splat cooled amorphous materials. However, large internal stresses are accummulated in the rapidly cooled amorphous magnetic material, and efforts to improve this defect have been executed by the use of heat treatment of the materials. In order to execute an easy heat treatment of the amorphous magnetic materials, the crystallization temperature (Tx) of the amorphous magnetic material must be generally higher than its Curie temperature (Tc). When the heat treatment is performed in the temperature range as defined by the relationship of $Tc<T_A<Tx$, both of the permeability and the thermal stability are enhanced. The condition of $Tx>Tc$ is thus one of the requirements for improving the magnetic permeability of the amorphous magnetic materials. The splat cooled amorphous magnetic materials proposed up to the present can satisfy one or two requirements with respect to the relevant properties, but there have not yet been proposed such splat cooled amorphous magnetic materials as those which can simultaneously satisfy all the requirements.

SUMMARY OF THE INVENTION

Accordingly, an essential object of the present invention is to provide amorphous materials with improved properties, each of which not only has a high magnetic flux density and high crystallization temperature, but also has the advantage of satisfying the respective conditions of $Tx-Tc>0$ and a saturation magnetostriction of approximately zero.

Another object of the present invention is to provide amorphous materials of the above described type, which can provide a variety of different and useful applications in magnetic circuit elements especially such as magnetic core materials of magnetic heads and transformers.

A further object of the present invention is to provide amorphous materials of the above-described type, the properties of which can be adjusted for respective specific applications through inexpensive processes.

In accomplishing these and other objects according to one preferred embodiment of the present invention, there is provided amorphous materials which comprise at least one element selected from the iron-transition metals of Fe, Co, and Ni, and at least one element selected from the metalloids of B, C, Si, and P, wherein the iron-transition metals of 0.5 to 10 atomic % are substituted with Mn. More specifically, with respect to the amorphous materials having a nominal composition of $Co_{100-x-(v+w)}Mn_xSi_vB_w$, the following conditions i.e., $0.5\leqq x\leqq 10$, $0\leqq v\leqq 15$, $5\leqq w\leqq 25$, and $5\leqq v+w\leqq 30$ are respectively satisfied according to the present invention. In order to further raise the value of the magnetic flux density, Co of the amorphous Co-Mn-Si-B materials is further substituted with Fe. The resultant materials have a nominal composition of $Co_{100-x-y-(v+w)}Fe_yMn_xSi_vB_w$ where $0.5\leqq x\leqq 10$, $0\leqq y\leqq 5$, $0\leqq v\leqq 15$, $5\leqq w\leqq 25$, and $5\leqq v+w\leqq 30$ are respectively satisfied. In addition, according to the present invention, it was further found that when the amorphous materials each partially substituted with Mn, and Mn and Fe as described above are further comprised of at least one element selected from groups IIIa, IVa, Va and VIa in the periodic table in an amount 0.2 to 5 atomic %, respectively, respective values of the crystallization temperature is further considerably raised.

Such amorphous materials as described hereinabove can provide a wide range of different and useful applications in magnetic circuit elements such as magnetic core materials of magnetic heads, transformers and the like.

BRIEF DESCRIPTION OF THE DRAWINGS

These and other objects and features of the present invention will become apparent from the following description taken in conjunction with the preferred embodiment thereof with reference to the accompanying drawings in which.

DETAILED DESCRIPTION OF THE PRESENT INVENTION

Figure 1:
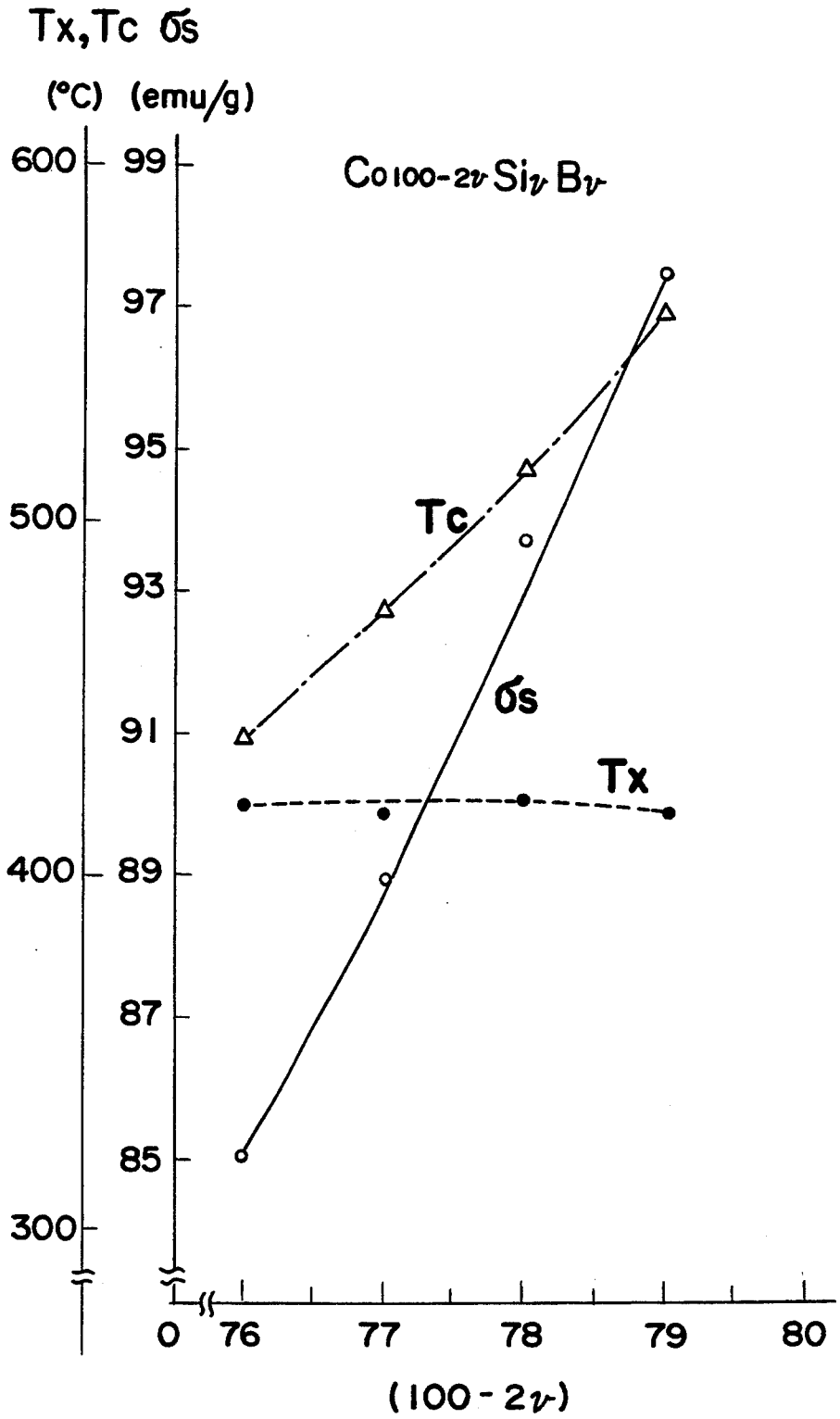
FIG. 1 shows respective plots of the magnetization, the Curie temperature, and the crystallization temperature as a function to the composition of conventional Co-Si-B amorphous materials.

With respect to splat cooled amorphous magnetic materials, such amorphous magnetic materials as having amorphous forms containing at least one iron-transition metal Fe, Co, Ni in 70–80 atom % and the rest with at least one metalloid B, C, Si, P in 30–20 atom % are well known to those skilled in the art. Among these well known splat cooled amorphous magnetic materials, Co based amorphous magnetic materials generally have the rather low saturated magnetic flux density (Bs), with a composition having the saturation magneto-striction λs of approximately zero being included therein. On the other hand, Fe based amorphous magnetic materials not only have high Bs, but also have high, positive Referring now to FIG. 1, there are shown correlations of results each having already been obtained in prior research works with respect to the properties of the Co based alloys; which have a nominal composition of $Co_{100-2x}Si_xB_x$ and the saturated magnetostriction of less than zero. As can be seen from these correlations, both of the saturation magnetization (as), i.e. the saturated magnetic flux density (Bs), and the Curie temperature (Tc) become larger in accordance with an increase of the ratio of the iron-transition elements to the metalloids at the room temperature, whereas the crystallization temperature (Tx) becomes smaller. These behaviours of the above described alloys have already been well known to those skilled in the art. Since the Co based amorphous magnetic materials shown in FIG. 1 are limited to those having comparatively high Bs, a relation of Tx<Tc always exists, and thus, an improvement of permeability can hardly be expected, even if the heating treatment is executed.

To begin with, the present invention was directed to developments of the Co based amorphous magnetic materials. This is due to the fact that the amorphous magnetic materials must be always stable against external stress. More specifically, based upon amorphous magnetic ternary system of Co, Si, and B, the inventors of the present invention worked on variational characteristics of the system with respect to σs, Tc, and Tx, with the addition of the fourth substance including at least one kind of element to the CoSiB system. In the course of the research work, the inventors found that with respect to the ternary system, unknown remarkable effects of σs, Tc, and Tx can be brought about, as the Co of the ternary system is partially substituted with Mn. In addition to the unknown remarkable effects as described above, it is also found that the ratio of the iron transition elements to the metalloids can be rendered to be high, as the Co of the ternary system described above is partially substituted with Mn. Based upon these newly discovered facts, the inventors of the present invention further confirmed the fact that there exists such a certain composition range as that which simultaneously shows the following characteristics, i.e., the respective high $\sigma_s$ (or Bs), Tx>Tc, and λs of approximately zero. As for one of the superior characteristics of the present invention, Tx of the amorphous system is considerably increased through the Mn substitution described above. Conventionally, so far as such type of the ternary system as described above is concerned, the fact that Tx is considerably increased in accordance with an increase in the amount of the metalloids has already been known to those skilled in the art. However, according to the conventional method, such increase of the Tx inherently, in turn causes Bs to be drastically reduced and thus, the magnetic materials become of little value, accordingly. On the other hand, the amorphous magnetic materials can be enhanced with respect to Tx, with Bs being, however, not alleviated, according to the present invention. In addition, the inventors of the present invention have also confirmed the fact that Tx of such system partially substituted with Mn as described above can be further raised, subject to the further addition of at least one kind of the elements selected from respective IIIa, IVa, Va and VIa groups in the periodic table. Owing to improvements of the amorphous magnetic materials according to the present invention, the resultant materials can be valid to produce a wide range of different and useful characteristics in magnetic circuit elements. In the following, the effects produced by the Mn substituting as described above is detailed.

Figure 2:
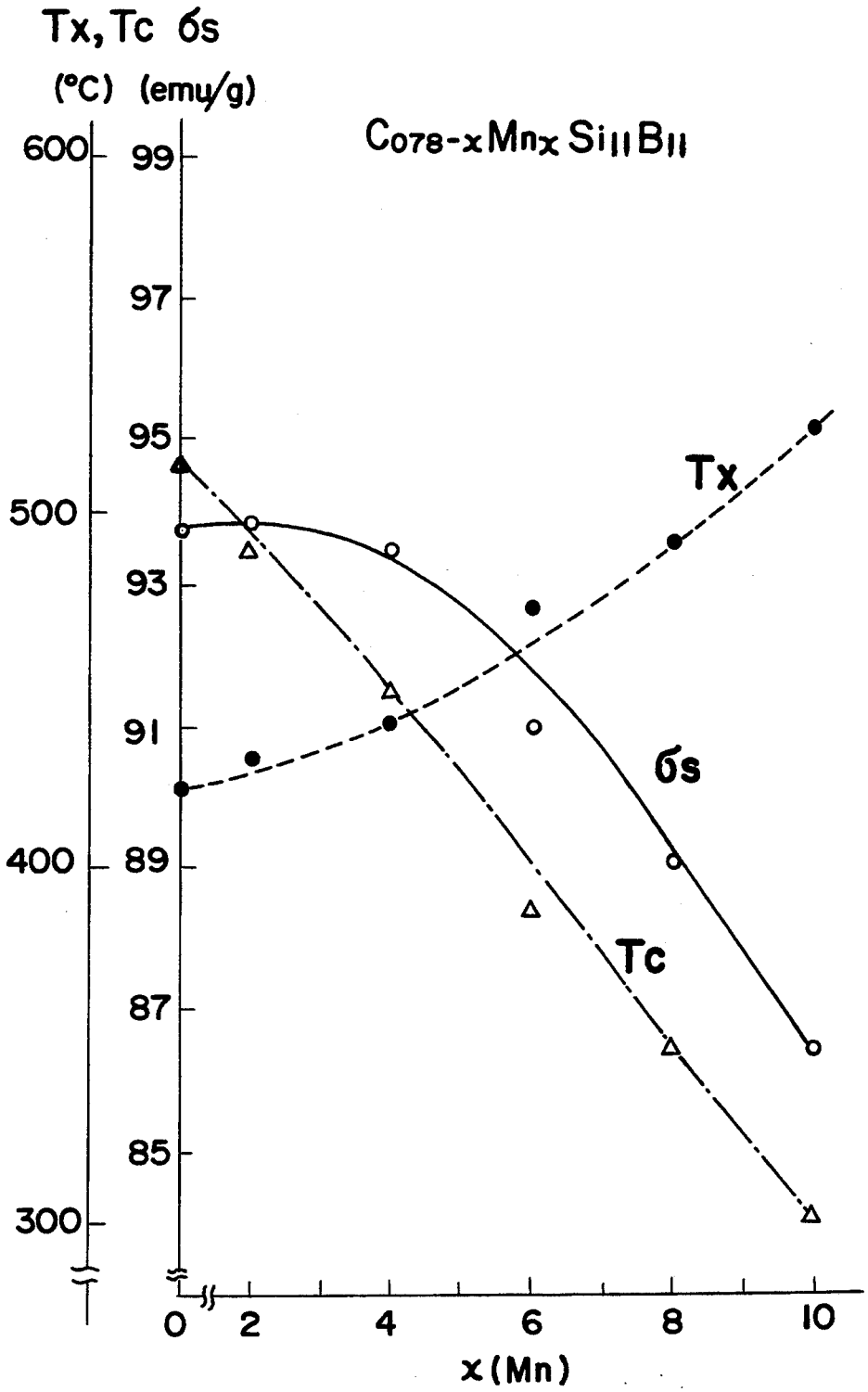
FIG. 2 shows respective plots of the magnetization, the Curie temperature, and the crystallization temperature as a function of the amount of Mn in the amorphous Co-Mn-Si-B materials according to the present invention.

Referring now to FIG. 2, there are shown respective variations of $\sigma_s$, Tc, and Tx, as Co constituting an amorphous magnetic material having a composition of $Co_{78}Si_{11}B_{11}$ is partially substituted with Mn. As can be seen from FIG. 2, with respect to materials having a nominal composition of $Co_{78-x}Mn_xSi_{11}B_{11}$ the value of σs is slightly increased in accordance with an increase of x, and a rather flat, local maximum point can be rendered in the vicinity of x=2. In the vicinity of x=3 to 4, the value of σs is approximately constant, while it is steadily decreased, as x is increased. With respect to Tc and Tx, Tc is considerably decreased, as x is increased, while Tx is increased in accordance with the increase of x and is extremely increased in the range of x>4. This feature of Tx is quite important and useful as for the characteristics of the amorphous magnetic materials. Namely, although the amorphous magnetic material having the composition of $Co_{78}Si_{11}B_{11}$ has substantially high σs of approximately 94 emu/g, Tc and Tx of this alloy are more than 515° C. (an exterpolated value) and 423° C., respectively. Hence, since Tx is smaller than Tc, the good effects to be caused by the heating treatment can not be expected, accordingly. On the other hand, by way of example, a novel amorphous magnetic material having a composition of $Co_{73}Mn_5Si_{11}B_{11}$, which can be obtained under the condition of x=5, has $\sigma_s$ of 93 emu/g and has respective Tc of 420° C. and Tx of 452° C. Hence, since Tx is larger than Tc, the effect of the heating treatment can be obtained, if the temperature of the heating treatment is set at 435° C. As is clear from the description in the foregoing, according to the present invention, the substitution of Mn in the amorphous magnetic materials of the CoSiB system permits the system to have respective temperatures, which can satisfy the relation of Tx>Tc, while respective values of $\sigma$s are not alleviated. Such effects as described above can be confirmed, if any one of the amorphous magnetic materials of CoBC system is partially substituted with Mn in the same manner as described above. However, this substitution is not so effective when compared with the former case.

Figure 3:
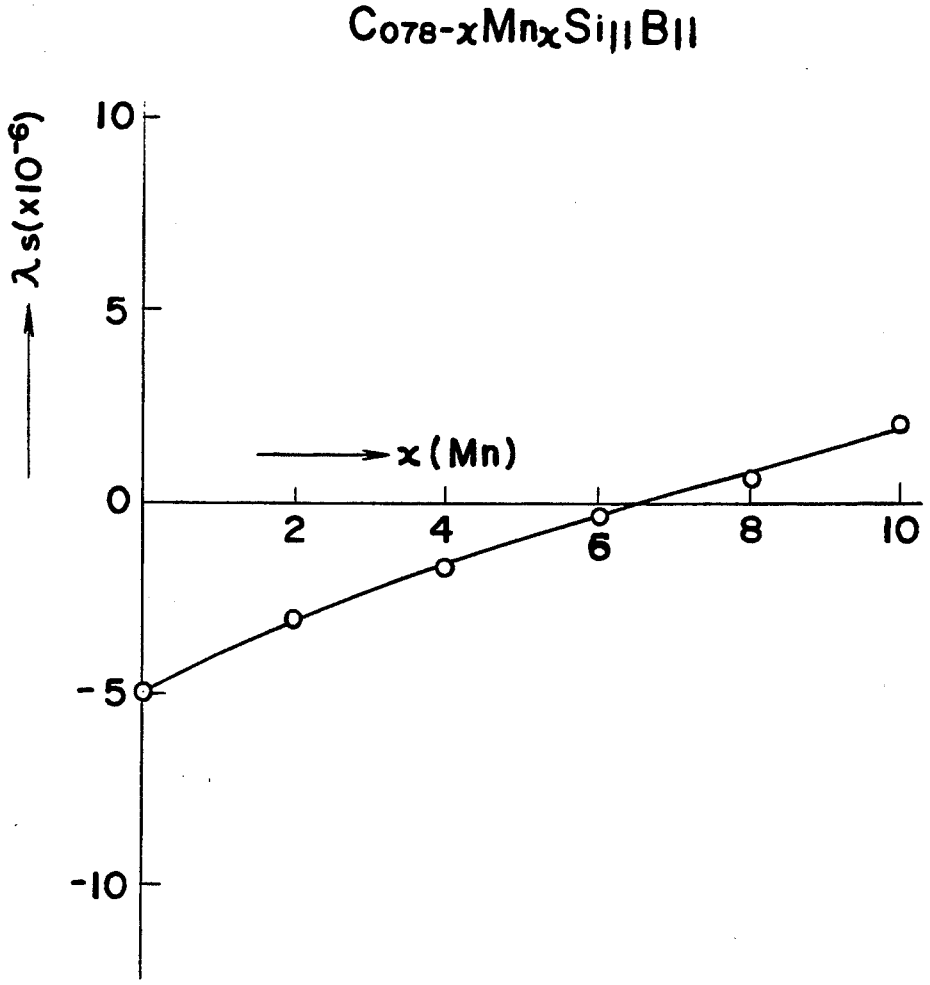
FIG. 3 is a plot of the saturation magneto-striction as a function of the amount of Mn in the amorphous Co-Mn-Si-B materials according to the present invention.

FIG. 3 shows how the saturation magnetostriction (As) of the above-described useful amorphous magnetic materials having a nominal composition of $Co_{78-x}Mn_xSi_{11}B_{11}$ varies with changes in x. The increase of x correspondingly turn the saturation magnetostriction λs slightly positive. However, the increase of the saturation magnetostriction λs with the increase of x is not so remarkable. The original amorphous magnetic material having a composition of $Co_{78}Si_{11}B_{11}$ has such a small, negative saturation magnetostriction value of $-5\times10^{-6}$. In accordance with progress of the substitution of Mn into Co constituting the composition described above, λs is increased in accordance with the increase of x, in which λs becomes zero in the vicinity of x=7 as can be seen in FIG. 3. Thus, it is possible to obtain an amorphous magnetic material whose saturation magnetostriction is approximately zero by the Mn substitution, with its Tx being also increased and its magnetic characteristics not being degraded. According to the present invention, further research work, in which the Mn substitution is executed for the materials of the CoSiB system each specifically provided with the different ratio of Co to (Si+B), was carried out. This research work presented the most effective composition range of the system. As described earlier, another advantage, which is rendered by the Mn substitution, is to considerably enhance the ratio of the iron-transition metals to the metalloids. More specifically, according to the prior research work, the amorphous phase can hardly be brought about, when the ratio of the iron transition materials to the metalloids does not lie in the vicinity of 0.85 to 0.70. However, by the use of the Mn substitution of the present invention, the ratio described above can be broadened for the range of 0.95 to 0.70, whereby the value of Bs of the materials can be further enhanced.

In the following, the specific limitation on the Mn substitution is detailed. First, supposing the generally expressed amorphous magnetic materials having a nominal composition of $Co_{100-x-(v+w)}Mn_xSi_vB_w$, in such materials, since the amorphous phase can exist in the range of $5\leqq v+w\leqq30$, the Mn substitution of the system can be effective in the range of $0.5\leqq X\leqq10$ under respective conditions of $0\leqq v\leqq15$ and $5\leqq w\leqq25$. Namely, as long as x lies below 0.5, the Mn substitution is not so effective. On the other hand, in the range of x>10, it is quite preferred to obtain high Tx, whereas the value of Bs, i.e., $\sigma$s is in turn decreased. However, the decrease of the value of Bs does not meet the main object of the present invention. Therefore, from the standpoint of the present invention where the magnetic properties of the resultant materials are to be valid to produce a wide range of different and useful characteristic in magnetic circuit elements, the value of x is chosen to be less than 10. However, in the range outside the above-described range of x>10, the effect to raise the value Tx is obtainable and thus, the choice of the range of x as described above is quite appropriate from the standpoint of obtaining the thermally stable amorphous materials, accordingly.

Figure 4:
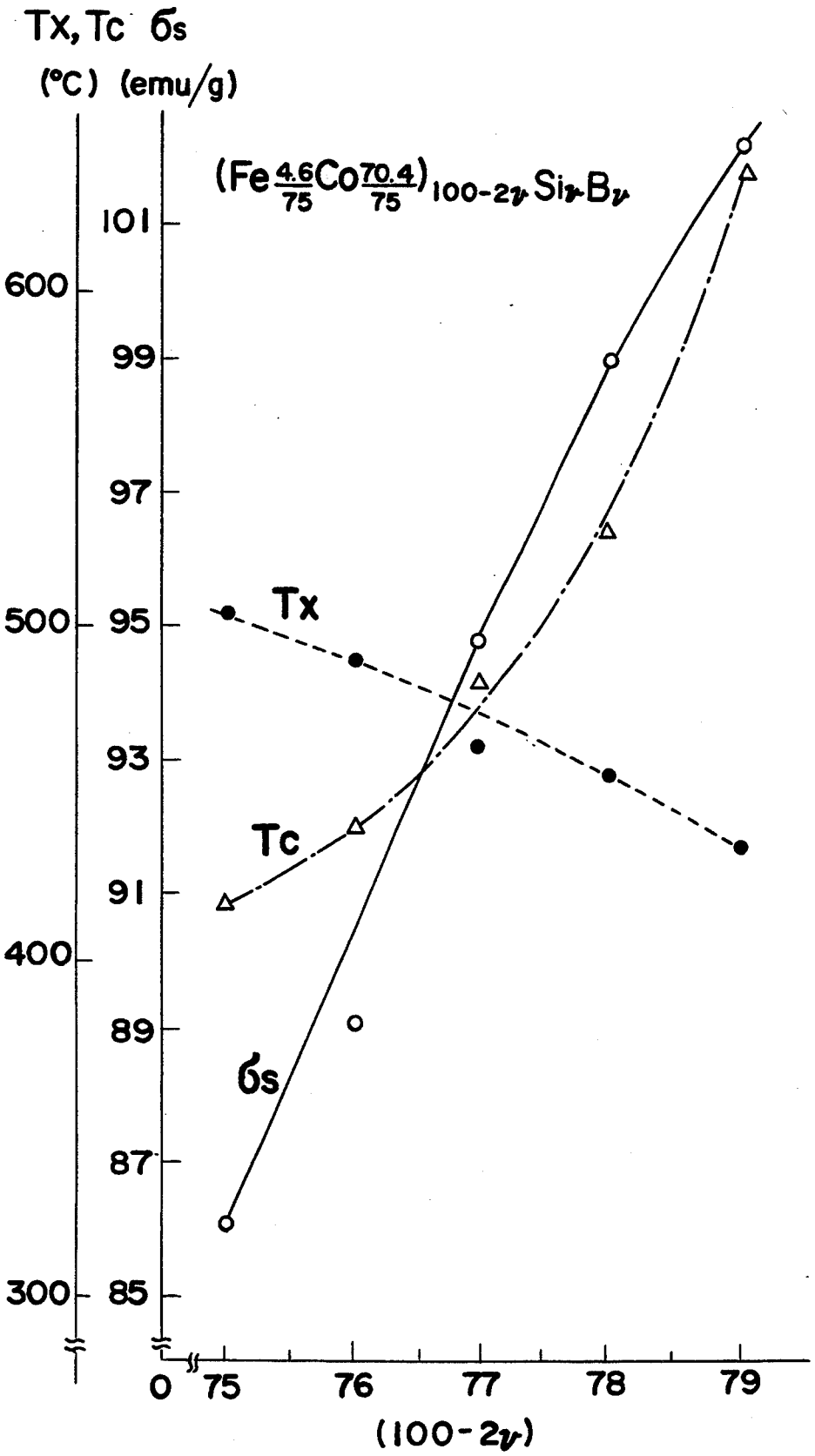
FIG. 4 shows respective plots of the magnetization, the Curie temperature, and the crystallization temperature as a function of the atomic weight of the iron transition elements for conventional amorphous Fe-Co-Si-B materials.

In the following, the results of the research work, which was carried out to further raise the value of Bs of the materials of the CoMnSiB system by partially substituting Co with Fe, are detailed. According to the research work, the following preferable results were obtained. Namely, it was found that both of Tx and Tc are raised to some extent, with both of the difference between Tx and Tc, and the value of as being increased with the increase of x in the most preferable manner. Referring now to FIG. 4, there are shown respective variational features of $\sigma_s$, Tc, Tx of relatively well known amorphous magnetic materials of CoFeSiB system having the saturation magnetostriction of approximately zero, while the results described above were specifically obtained in such composition range as that which can provide high Bs. As can be seen from FIG. 4, the condition of Tx-Tc>0 is satisfied in a composition range, which provides respective values of Bs relatively higher than those obtained in the CoSiB system, the effect of which depends upon the Fe substitution. However, in order to satisfy the aforementioned appropriate conditions, the value of $\sigma$s is limited to approximately less than 90 emu/g.

Figure 5:
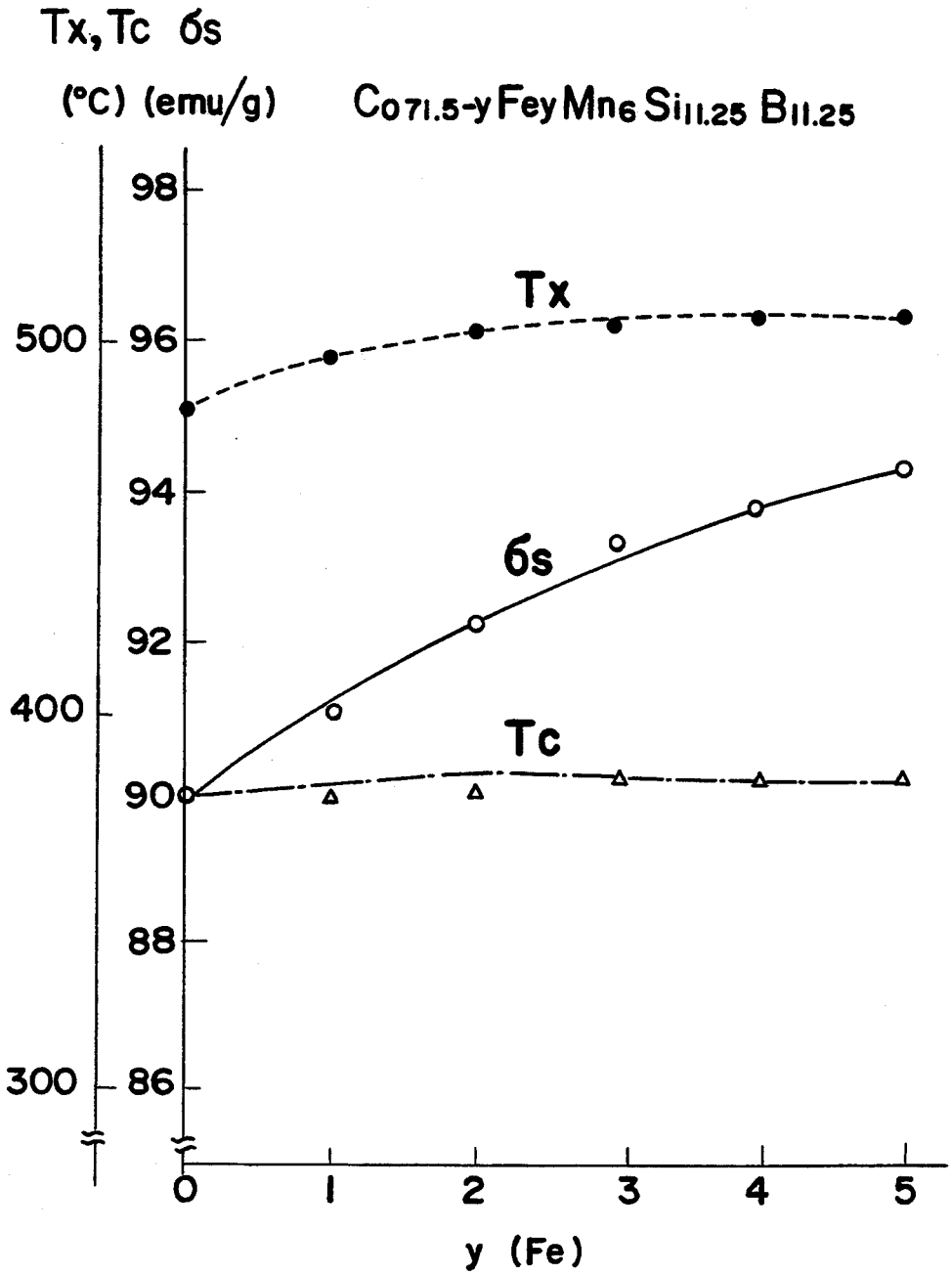
FIG. 5 shows respective plots of the magnetization, the Curie temperature, and the crystallization temperature as a function of the amount of Fe in the amorphous Fe-Co-Mn-Si-B materials according to the present invention.

Referring now to FIG. 5, there are shown the same results as shown in FIG. 4 with respect to the amorphous materials having a nominal composition of $Co_{71.5-y}Fe_yMn_6Si_{11.25}B_{11.25}$. As can be seen in this figure, as of this material is steadily increased with an increase of y, and the following approximate relationship can exist.

$$\sigma_s \cong \sigma_0\left(1+\frac{y}{\sigma_0}\right) \quad (1)$$

where $\sigma_o$ is the value of $\sigma_s$ at y=0.

As is clear from FIG. 5, Tx is correspondingly increased with the increase of y up to the value of y=3, while in the range of y>3, the increase rate of Tx becomes small. Moreover, Tc is slightly increased with the increase of y. Thus, the value of Tx−Tc is increased with the increase of y, whereby the heating treatment of the materials is-effectively accomplished. With respect to the saturation magnetostriction As, the material having a composition of $Co_{71.5}Mn_6Si_{11.25}B_{11.25}$ has the negative, saturation magnetostriction of approximately zero. However, in accordance with the increase of y, λs takes the value of zero at approximately y=1, and becomes almost positive, subject to the increase of y. Accordingly, it is possible to obtain the material having the saturation magnetostriction of approximately zero according to amorphous magnetic materials of CoFeMnSiB system. With respect to the upper limit of y, this figure indicates y=5. This is due to the fact that when x takes the value of 10, which is the upper limit relating to Mn, the saturation magnetostriction λs takes the uppermost positive value of more than $5\times10^{-6}$ at y=5, the value of which directly relates to y. Thus, the range over y of 5 is excluded.

Figure 6:
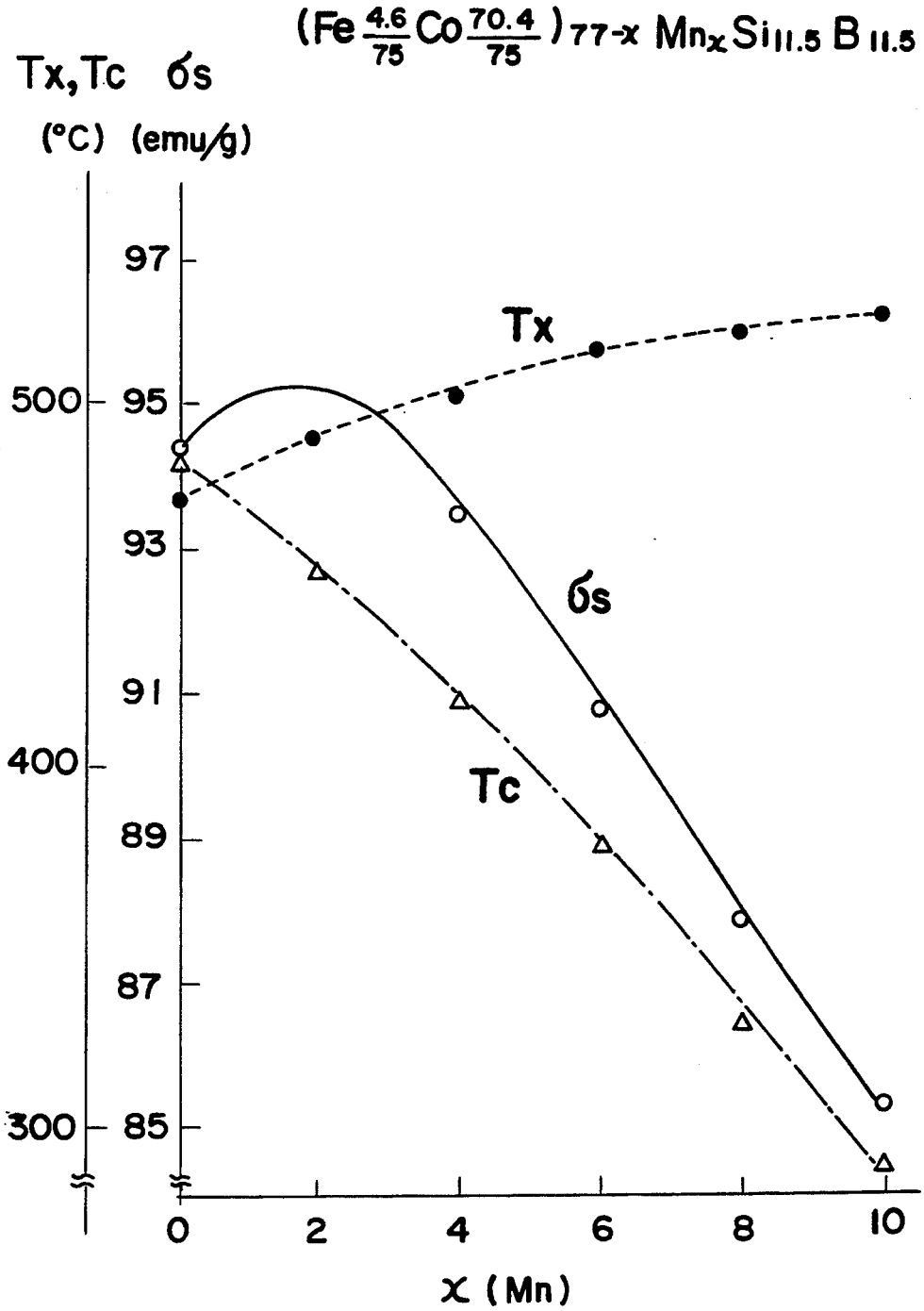
FIG. 6 shows respective plots of the magnetization, the Curie temperature, and the crystallization temperature as a function of the amount of Mn in the amorphous Fe-Co-Mn-Si-B materials according to the present invention.
Figure 7:
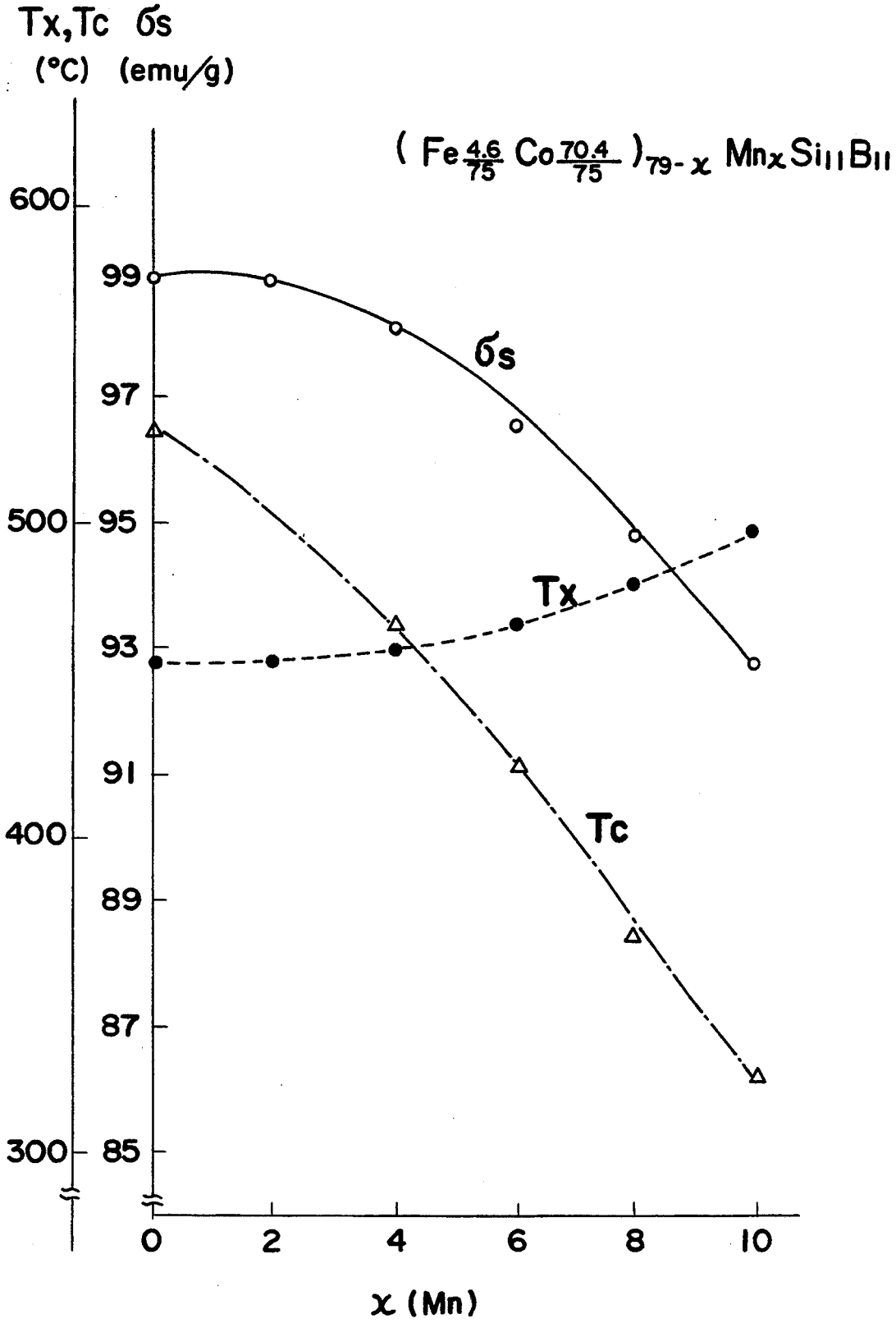
FIG. 7 shows respective plots of the magnetization, the Curie temperature, and the crystallization temperature as a function of the amount of Mn in the amorphous Fe-Co-Mn-Si-B materials having different atomic weights of the iron transition elements in comparison with the materials employed in FIG. 6 according to the present invention.
Figure 8:
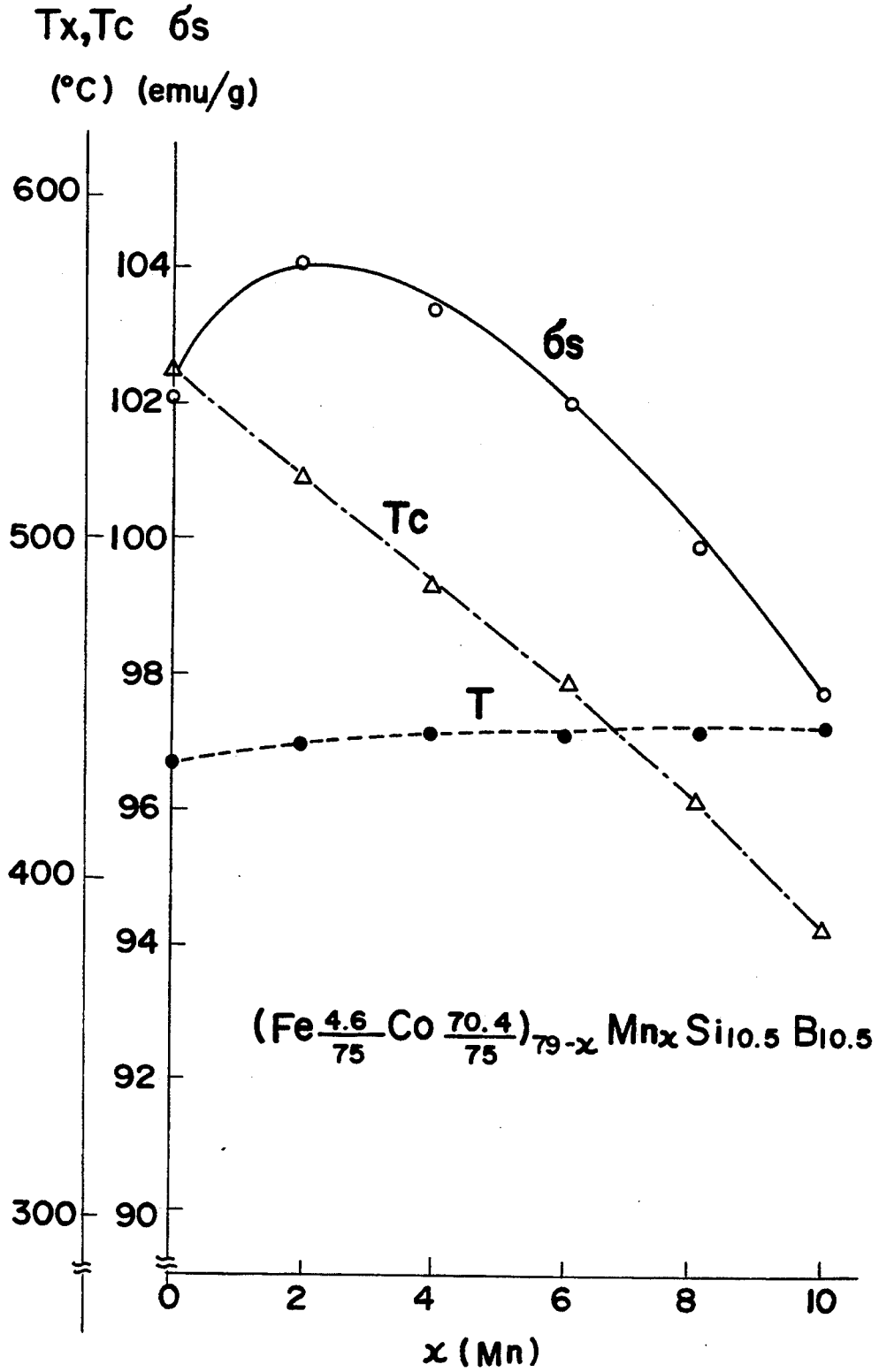
FIG. 8 shows respective plots of the magnetization, the Curie temperature, and the crystallization temperature as a function of the amount of Mn in the amorphous Fe-Co-Mn-Si-B materials having different atomic weights of the iron transition elements in comparison with the materials employed in FIGS. 6 and 7 according to the present invention.

Referring now to FIGS. 6, 7, and 8, there are shown respective plots of $\sigma_s$, Tc, and Tx with respect to x, i.e., the substitution amount of Co of the CoFeSiB system with Mn, while respective figures relates to specifically composed CoFeSiB systems each having the different ratio of the iron transition metals to the metalloids. Namely, FIG. 6 relates to amorphous materials having a nominal composition of $(Fe_{4.6/75}Co_{70.4/75})_{77-x}Mn_xSi_{11.5}B_{11.5}$. FIG. 7 relates to amorphous materials having a nominal composition of $(Fe_{4.6/75}Co_{70.4/75})_{78-x}Mn_xSi_{11}B_{11}$, while FIG. 8 relates to amorphous materials having a nominal composition of $(Fe_{4.6/75}Co_{70.4/75})_{79-x}Mn_xSi_{10.5}B_{10.5}$. As is clear from these figures, irrespective of the amorphous materials employed, $\sigma$s shows its maximum in the vicinity of x=2. Furthermore, Tc is considerably decreased in accordance with the increase of x, while Tx is considerably increased in accordance with the increase of x. Accordingly, as is clear from these results, the present invention can provide such amorphous materials as those which not only have the high magnetic flux densities and the high crystallization temperatures (Tx), but also have the advantage of satisfying respective conditions of Tx-Tc>0 and $\lambda s=0$. Consequently, the amorphous materials exhibit the most advantageous characteristics for specific product applications such as magnetic heads, transformer cores and the like. Furthermore, the amorphous magnetic materials of the present invention overcome an unsolved phenomenological problem related to the conventional amorphous magnetic materials, wherein when Bs is raised, Tx is correspondingly lowered, with Tc being in turn raised, simultaneously.

As described earlier, according to the present invention, in order to obtain the amorphous materials each having its highest crystallization temperature (Tx), such amorphous magnetic systems as those whose specific compositions are partially substituted with Mn are further improved by adding at least one kind of the elements selected from respective Groups IIIa, IVa, Va, VIa in the periodic table. The resultant materials substantially show thermally stable characteristics, respectively. In the following, effects caused by the further addition of at least one such element to the improved amorphous magnetic materials are further detailed.

Figure 9:
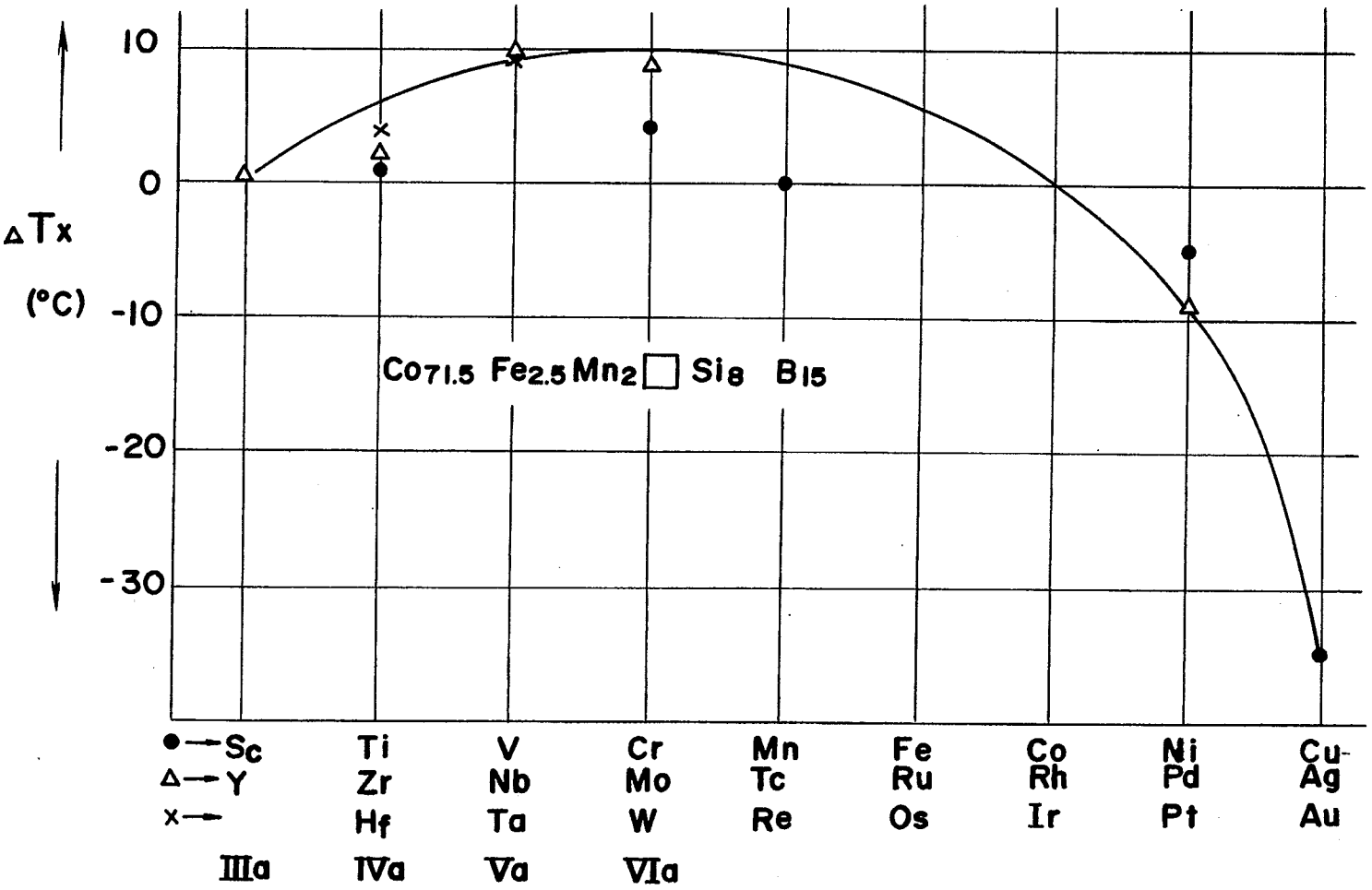
FIG. 9 is a plot of the crystallization temperature, which can be obtained, when a blank i.e., □ constituting the amorphous material having a nominal composition of $Co_{71.5}Fe_{2.5}Mn_2\square Si_8B_{15}$ is filled with one atomic weight of any one of the elements according to the present invention.

Referring now to FIG. 9, there are shown respective results of relative variations of the crystallization temperature (Tx), which can be obtained, when a blank i.e., □ constituting amorphous materials having a nominal composition of $Co_{71.5}Fe_{2.5}Mn_{2.0}\square Si_8B_{15}$ is appropriately filled with one atomic weight of any one of the elements described above. More specifically, respective plots shown in FIG. 9 indicate respective increments or differences, i.e., ΔTx, each of which can be obtained as a difference caused by Tx given by the above-described addition of one specific element of one molecular weight, when Tx correspondingly given by the addition of one atomic weight of Mn is chosen as a reference. As can be seen from this figure, as long as Mn, or more specifically, any element selected from the Group VIIa is chosen as the reference, the addition of the element selected from Groups IIIa, IVa, Va and VIa can increase the value of Tx. Among these elements described above, respective elements selected from the Va and VIa groups can most effectively serve for raising Tx of the amorphous material described above. In the following, respective limits of addition of so chosen elements as described above is detailed. With respect to amorphous materials having a nominal composition of $(CoFeMn)_{100-y-z}\square_y(X)_z$, the amorphous phase can be normally effected, if z takes the value ranging from 15 to 30. As far as x is concerned, such a combination of B, Si and C, etc. is most well-known to those skilled in the art. In the above-described nominal composition, when y is less than 2, the effect of raising Tx is rather weak. However, in a case where y is more than 5, although effects of raising Tx become large, the value of $\sigma_s$ is considerably decreased. Hence, such material as having the above-described composition is limited in its applications as for the relevant material. In particular, since metallic tapes have recently become commercially available, magnetic cores to be used for magnetic heads for recording operation in conjunction with such metallic tapes as having high coercive force are substantially required to exhibit high Bs. In view of such case as described above, the present invention is directed to provide the amorphous magnetic materials each being capable of exhibiting particularly stable, high Bs.

In the following, some embodiments of the present invention are detailed.

First of all, the experimental procedure, which was executed for each embodiment, is detailed hereinbelow. For every experimental run, raw materials first having been blended were fed within an alumina crucible and then, melted through high-frequency heating treatment in an argon gas atomosphere, thereby to obtain each parent material of the respective amorphous magnetic materials. The parent material was further fed within a quartz nozzle and then, melted again. The re-melted parent material was forcibly sprayed onto a copper-line circumferential surface of a rotating drum having a substantial outer diameter of 30 cm, which was being rotated at a high speed, for example, 1200 rpm, thereby to obtain ribbons of amorphous magnetic material, each having a width of 2 cm and a thickness of 0.04 mm , through the splat cooled method. The ribbons were determined to be glassy by X-ray diffraction method. The value $\sigma$s of material was measured by the use of a sample vibrating type magnetometer, while the value of Tc was measured with a magnetic balance. The value of Tx of the material was measured by the DTA method. The coercive force (Hc) of the material was determined, after the static magnetization curve was obtained with an automatic magnetic flux meter. The permeability ($\mu$e) of the material was measured in the magnetic field of 1~10 m Oe by the use of the Maxwell bridge at a frequency of 1 KHz, wherein a sample, which was made by laminating ten sheets and wound with winding wires of 15 turns was prepared for the measurement. The sheets each having a ring shape of an outer diameter of 8 mm and an inner diameter of 4 mm were obtained from the above-described ribbons through a punching operation. The saturation magnetostriction (As) of the material was obtained by the gauge method, with five sheets each having a diameter of 8 mm being laminated, wherein each of the sheets was obtained from the ribbons described above through the punching operation.

EXAMPLE 1

An amorphous material was obtained by quenching a material having a composition of $Fe_{2.5}Co_{71.5}Mn_{3.0}Si_{11}B_{12}$ through the splat cooling method of the single roller type. Resulting properties of this amorphous material, i.e., $\sigma_s$, Hc, $\mu$e, Tc and Tx were 92 emu/g, 20 mm Oe, 10,000, 428° C. and 495° C., respectively. However, after having been heat-treated for twenty minutes at 455° C., the magnetic properties of the amorphous material were changed to Hc of 10 m Oe, $\mu e$ of 40,000 and $\lambda s$ of approximately zero, respectively.

EXAMPLE 2

An amorphous material was obtained by quenching a material having a composition of $Fe_{2.5}Co_{71.5}Mn_{3.0}Si_8B_{15}$ through the splat cooling method of the single roller type. Magnetic properties of this amorphous material, i.e., $\sigma_s$, Hc, $\mu e$, Tc and Tx were 95 emu/g, 20 m Oe, 10,000, 456° C. and 488° C., respectively. However, after having been heat-treated for ten minutes at 465° C. the magnetic properties of the amorphous material were changed to Hc of 15 m Oe, $\mu e$ of 30,000 and As of approximately zero, respectively.

EXAMPLE 3

An amorphous material was obtained quenching a material having a composition of $(Fe_{2.5}Co_{71.5}Mn_{3.0})_{87/77}Si_5B_8$ through a splat cooling method of the single roller type. Magnetic properties of this amorphous material, i.e., $\sigma_s$, Hc, $\mu e$, Tc and Tx were 97 emu/g, 20 m Oe, 8,000,475° C., 480° C., respectively. However, after having been heat-treated for three minutes at 478° C., the magnetic properties of the amorphous material were changed to Hc of 20 m Oe and $\mu e$ of 8,000, respectively.

As is clear from the experimental results of these examples, the larger the difference of Tx-Tc is, the more effective the heating treatment is for each of the amorphous materials. Moreover, the heating treatment contributes to improve the thermal stability of the amorphous material.

EXAMPLE 4

An amorphous material was obtained by quenching a material having a composition of $(Fe_{2.5}Co_{71.5}Mn_3)_{90/77}Si_2B_8$ through the splat cooling method of the single roller type. Magnetic properties of this amorphous material, i.e., $\sigma_s$, $\mu e$, and Tx were 140 emu/g, 500 and 210° C., respectively. However, after having been heat-treated for three to ten minutes at 150° C. in a transverse magnetic field with respect to the surface of sheets, the magnetic property of the material was changed to $\mu e$ of 2,000.

EXAMPLE 5

An amorphous material was obtained by quenching a material having a composition of $(Fe_{2.5}Co_{71.5}Mn_3)_{95/77}B_5$ through the splat cooling method of the single roller type. Magnetic properties of this amorphous material, i.e., $\sigma_s$, $\mu e$, and Tx were 145 emu/g, 500, and 200° C., respectively. However, after having been heat-treated for three to ten minutes at 150° C. in a transverse magnetic field, the magnetic permeability of sheet like material was changed to 2,000 with respect to $\mu e$.

EXAMPLE 6

An amorphous material was obtained by quenching a material having a composition of $Co_{71.5}Fe_{2.5}Mn_2Nb_{0.5}Cr_{0.5}Si_8B_{15}$. Magnetic properties of this amorphous material were Tx of 485° C. and $\sigma_s$ of 91 emu/g, respectively. In contrast, for an amorphous material obtained by quenching a material having a composition of $Co_{71.5}Fe_{2.5}Mn_{3.0}Si_8B_{15}$, the magnetic properties were $\sigma s$ of 96.5 emu/g and Tx of 479° C.

EXAMPLE 7

An amorphous material was obtained by quenching a material having a composition of $Co_{71.5}Fe_{2.5}Mn_2Nb_{0.5}Ta_{0.5}Si_8B_{15}$. Magnetic properties of this amorphous material were Tx of 488° C. and $\sigma_s$ of 91.5 emu/g, respectively.

EXAMPLE 8

An amorphous material was obtained by a quenching material having a composition of $Co_{71.5}Fe_{2.5}Mn_2Hf_{0.5}Mo_{0.5}Si_8B_{15}$. Magnetic properties of this amorphous material were Tx of 485° C. and $\sigma_s$ of 91.5 emu/g, respectively.

EXAMPLE 9

An amorphous material was obtained by quenching a material having a composition of $Co_{71.5}Fe_{2.5}Mn_2Nb_{0.5}Mn_{0.25}Cr_{0.25}Si_8B_{15}$. Magnetic properties of this amorphous material were Tx of 490° C. and $\sigma s$ of 92.0 emu/g, respectively.

As is clear from the examples described in the foregoing, the present invention is directed to cause Tx of the amorphous material to be considerably increased, while the value of Bs ($\sigma_s$) of the amorphous material is either increased or not so decreased. Furthermore, all of the amorphous materials of the Co system have the saturation magnetrostrictions of less than $2\times10^{-6}$ according to the present invention.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. An amorphous material of the formula $Co_{100-x-y-(v+w)}Fe_yMn_xSi_vB_w$, where $0.5 \leqq x \leqq 10$, $0 < y \leqq 5$, $0 \leqq v \leqq 15$, $5 \leqq w \leqq 25$, and $5 \leqq v+w \leqq 30$.

2. An amorphous material consisting essentially of 50 to 94.5 atomic % of cobalt, 0.5 to 10 atomic % of manganese, 0 to 15 atomic % of silicon, 5 to 25 atomic % of boron, the sum of the atomic percents for the silicon and boron being in a range of 5 to 30 atomic percent.

* * * * *

UNITED STATES PATENT AND TRADEMARK OFFICE

CERTIFICATE OF CORRECTION

PATENT NO. : 5,358,576

DATED : October 25, 1994

INVENTOR(S) : Harufumi SENNO et al.

It is certified that error appears in the above-identified patent and that said Letters Patent is hereby corrected as shown below:

On the title page, insert item [*] and the following statement:

--The terminal nineteen (19) months of the term of this patent has been disclaimed.--

Signed and Sealed this

Tenth Day of October, 2000

*Attest:*

*Attesting Officer*

Q. TODD DICKINSON

*Director of Patents and Trademarks*